US007484805B2

(12) United States Patent
Baum

(10) Patent No.: US 7,484,805 B2
(45) Date of Patent: Feb. 3, 2009

(54) ADJUSTABLE SEAT OR TABLE

(76) Inventor: Matthew Charles Baum, 861 Washington Ave., Washington Township, NJ (US) 07676

( * ) Notice: Subject to any disclaimer, the term of this patent is extended or adjusted under 35 U.S.C. 154(b) by 0 days.

(21) Appl. No.: 11/644,454

(22) Filed: Dec. 23, 2006

(65) Prior Publication Data

US 2008/0150338 A1 Jun. 26, 2008

(51) Int. Cl.
*A47C 1/038* (2006.01)

(52) U.S. Cl. ..... 297/344.15; 297/344.17; 248/421

(58) Field of Classification Search ..... 297/344.12, 297/461, 462, 344.15, 344.17; 248/396, 248/421 X, 157
See application file for complete search history.

(56) References Cited

U.S. PATENT DOCUMENTS 2,821,242 A * 1/1958 Manegold ..... 297/344.15 X
2,982,336 A * 5/1961 Minici ..... 297/344.12 X
4,232,901 A * 11/1980 Harrington et al. ..... 297/462 X
5,251,864 A * 10/1993 Itou ..... 297/344.12 X
6,170,914 B1 * 1/2001 Chang ..... 297/344.17 X

* cited by examiner

*Primary Examiner*—Anthony D. Barfield

(57) ABSTRACT

A pair of parallel moving surfaces, such as may be used for construction of an adjustable height table or seat are connected by a plurality of pantographs or "lazy tongs" mechanisms, each driven from a differentially threaded control rod.

By suitable gearing connections among them, the pantographs are caused to operate in concert, and thus to keep the surfaces parallel as the distance between them is continuously varied.

By appropriate mounting of the pantograph ends, the mechanisms are allowed to fold closer together at the minimum separation distance, thereby further minimizing this separation. The use of a set of springs assists in expansion from this minimized separation situation.

The overall result is a simply operated mechanism for the continuous separation adjustment of a pair of parallel moving surfaces, together with the maximization of the range of separation adjustment between the two surfaces, concomitant with a minimization of the size and weight of the overall apparatus.

13 Claims, 7 Drawing Sheets

ADJUSTABLE SEAT OR TABLE

FIELD OF THE INVENTION

The present invention relates to a pair of parallel moving surfaces, which may be used for bearing weight at an adjustable height; for use as an adjustable height seat or table, and more particularly to such an assembly in which the adjustment is accomplished by means of a parallelogram or "lazy tongs" arrangement.

BACKGROUND OF THE INVENTION

In the field of astronomy, it is common to adjust the telescope or other observing apparatus for optimal performance, and then for the observer to so position himself as to comfortably align his eye with the optical exit pupil. This often requires that the observer sit on a surface which is adjusted in height to suit his or her personal characteristics as well as the aforementioned observing apparatus.

While there are many adjustable height seats and chairs presently used for this purpose, none appears to have been designed to be simultaneously light in weight and capable of being compressed to a compact size for easy transportation. The present invention is designed to address both of these issues, while also providing ease of continuous adjustment over a wide range of useful heights.

It has also been noted that these characteristics may be useful or helpful in other areas, such as adjustable tables, or adjustable seats for machinists, for medical situations, to accommodate children as they grow, and for convenience of the elderly or infirm.

SUMMARY OF THE INVENTION

The present invention is concerned primarily with advantages which accrue from a novel arrangement for separating and adjusting two essentially parallel surfaces. A secondary benefit is that the overall assembly can be made compact and light in weight, for ease of storage and transportation.

The various features of novelty which characterize the invention are pointed out in detail in the claims annexed to and forming a part of this disclosure. For a better understanding of the invention, its operation and specific advantages, reference should be made to the drawings and descriptive matter in which there are illustrated and described preferred embodiments of the invention.

The principal object of the invention is to allow a pair of moveable surfaces to be continuously adjusted in relative spacing; in particular, to adjust the height of a seat relative to a fixed floor or other surface.

The adjustment is achieved by the use of a plurality of parallelogram apparatuses, frequently called "lazy tongs." Each parallelogram apparatus has a pair of ends which are connected to "travelers" driven apart or together so as to actuate the "lazy tongs" to either extend or to contract. In a preferred and described embodiment, the travelers are mounted on and threadably connected to oppositely threaded portions of a number of driving rods. The motions of the driving rods are coordinated by the gearing which is used to connect them at or near their end points. In this way either end or the center of any of the driving rods may be used to actuate the adjustment.

The described embodiment allows for extreme compactness when adjustment is made to the minimum height or separation. This is useful for transportation or storage. Also, the design allows for the attainment of considerable strength while using light-weight structural materials. This furthers an additional important object of the invention.

A prototype of the invention has been constructed, employing three pantograph assemblies, and has proven to bear the weight of a variety of observers at various heights and adjustment positions.

BRIEF DESCRIPTION OF THE DRAWINGS

The arrangement and advantages of the present invention can be better appreciated with reference to the accompanying drawings, of which.

DETAILED DESCRIPTION OF THE EXEMPLARY EMBODIMENT

In accordance with the subject invention, the illustrations of FIG. 1 through FIG. 6 have been drawn from an actual prototype made and tested using the concepts disclosed herein. This particular embodiment is intended for illustrative purposes only, and should not be considered as limiting the scope of the claims made below.

Figure 1:
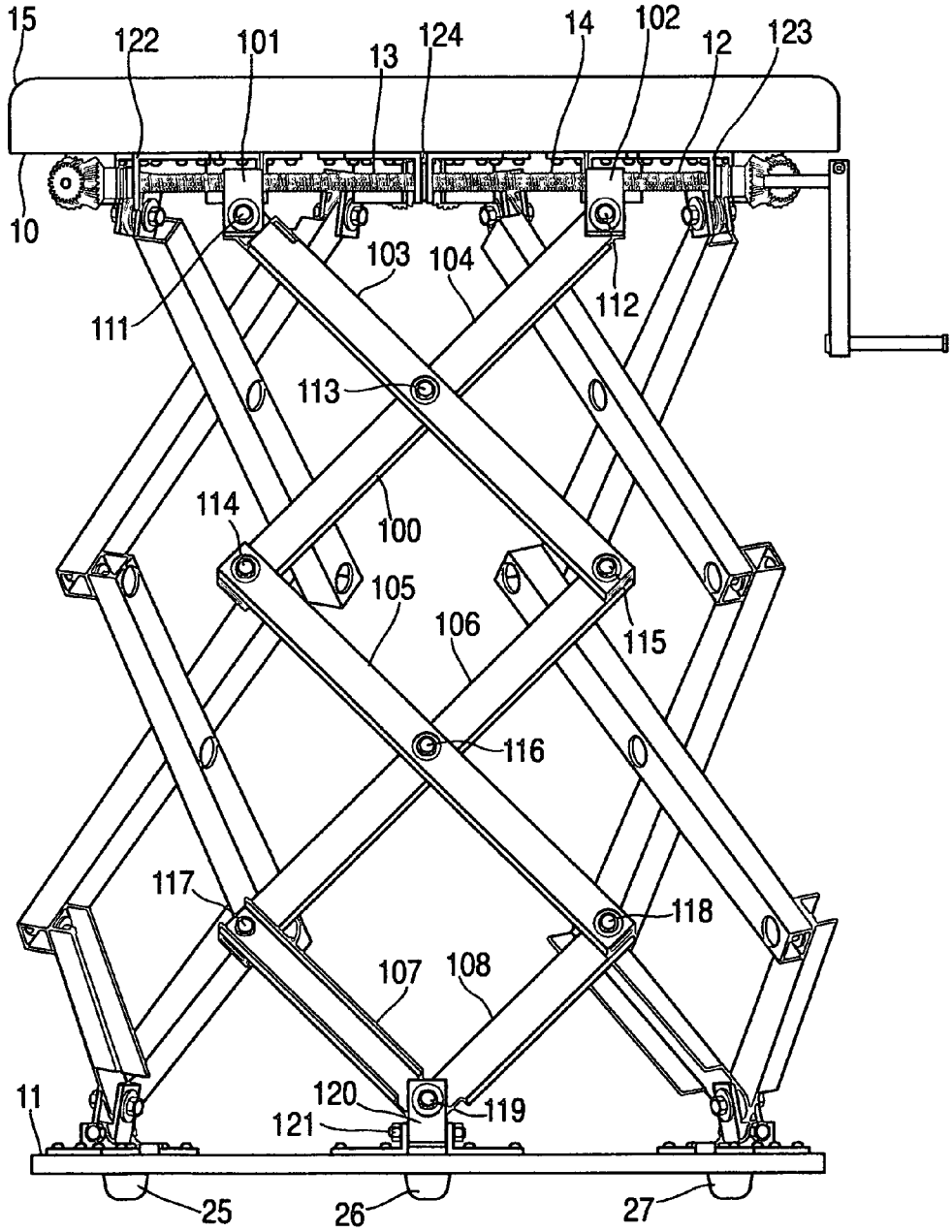
FIG. 1 is a side view of a typical apparatus in a partially extended condition, showing one of the multiple pantographs "straight on." This view also shows the driving rod for this pantograph, as well as its lower pivot point mount.
Figure 3:
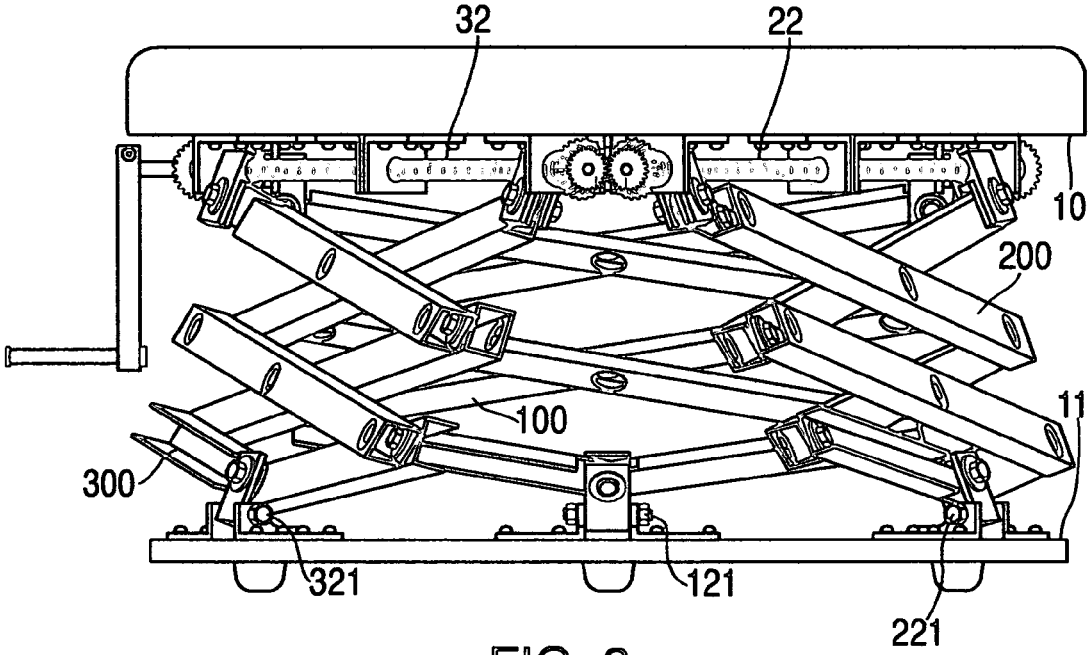
FIG. 3 is a view of the apparatus partially compressed, and with the surfaces thus at an intermediate degree of separation.

FIG. 1 shows a side view of a preferred embodiment, wherein the two movable (and substantially flat) surfaces (upper surface 10 and lower surface 11) are separated from each other to an intermediate position. This view also depicts three identical pantograph assemblies, of which one (100) is shown "head-on," and is described in detail. (The other two pantograph assemblies—200. 300 as shown in FIG. 3—are substantially identical.) Pantograph assembly 100 consists of pairs of full members 103 and 104, 105 and 106, and a pair of half-members, 107 and 108. The use of two full sections (pairs) as shown was chosen for convenience and practicality. At least one full section and one half section will suffice. Also, while the described embodiment employs three sets of pantographs, other numbers may be used as well. In practice, the full and half section members (103, 104, 105, 106, 107, and 108) have been fabricated of material having a substantially square cross-section, in the interest of improving both the strength and the rigidity of the overall structure.

For purposes of simplification, only a single pantograph will be described in detail. The remaining ones are identical in all physical respects.

Each pantograph consists of at least one pair of upper members (103, 104) crossing each other and movably connected by a central pivot 113, and a pair of lower half-members, (107, 108), terminating at a pivot point 119, or distal end, as related to the upper surface 10. In the described embodiment, an additional pair of members (105, 106), moveably connected by central pivot point 116, has been included. The upper pair of members (103, 104) are movably connected to the lower pair of members (105, 106) by the pivots at 114 and 115. The lower set of full members (105, 106) are in turn movably connected to the lower pair of half-members (107, 108) at pivot points (117, 118).

The remaining ends of half-members (107, 108) are movably connected together as well as to hinge block 120 by means of pin assembly 119. Hinge block 120, in turn is hingedly connected by means of hinge pin assembly 121 to the lower surface or base piece 11. (In FIG. 1 additional parts are shown, but the mating hinge portion could as easily be formed as a part of lower surface piece 11.) By this means, the pantograph is able to extend in distance from base 11, and also to rotate in a direction perpendicular to its own plane of operation by pivoting around hinge pin assembly 121.

The upper (or proximal, as related to the upper or first surface 10) ends of the pantograph pair members (103, 104) are connected to two travelers, 101 and 102, which "ride" in opposite directions on driving rod 12. These travelers are symmetrically different from one another. The travelers are threadably connected to the driving rod 12; travelers 101 and 102 having oppositely "handed" threads. That is, one end of each rod (and corresponding traveler) is threaded with left-hand threads, and the other end is threaded with right-hand threads. In like manner, the two sections of driving rod 12 are threaded oppositely, one having right-hand threads and one having left-hand threads, (13, 14) so as to accommodate the two travelers which ride upon them. (The same arrangement is used for the identical driving rods 22 and 32, and the hardware associated with them.)

The net result is that when rod 12 is rotated on its axis, the travelers 101 and 102 will be driven apart or together, dependent on the direction of rotation. Coarser threads (13, 14) will result in greater pantograph extension for a given amount of rod rotation. Still greater extension for a given rotation can be obtained by the use of "multiple lead" or "multiple start" threads.

The connection between traveler 101 and pantograph member 103 is by means of a pin/pivot assembly 111, which allows relative rotation as the pantograph is expanded or compressed. Similarly, traveler 102 is pivotally connected to pantograph member 104 at pivot assembly 112.

FIG. 1 also depicts the mounting components (122, 123, 124) used for supporting driving rod 12. In has been found useful to include the center bearing mounting point 124, so as to minimize the unsupported lateral force on the driving rod. This is also the point at which a gear can be fastened to the center of driving rod 12, from which gearing the mechanism may be operated by means of a motor or motors.

Figure 2:
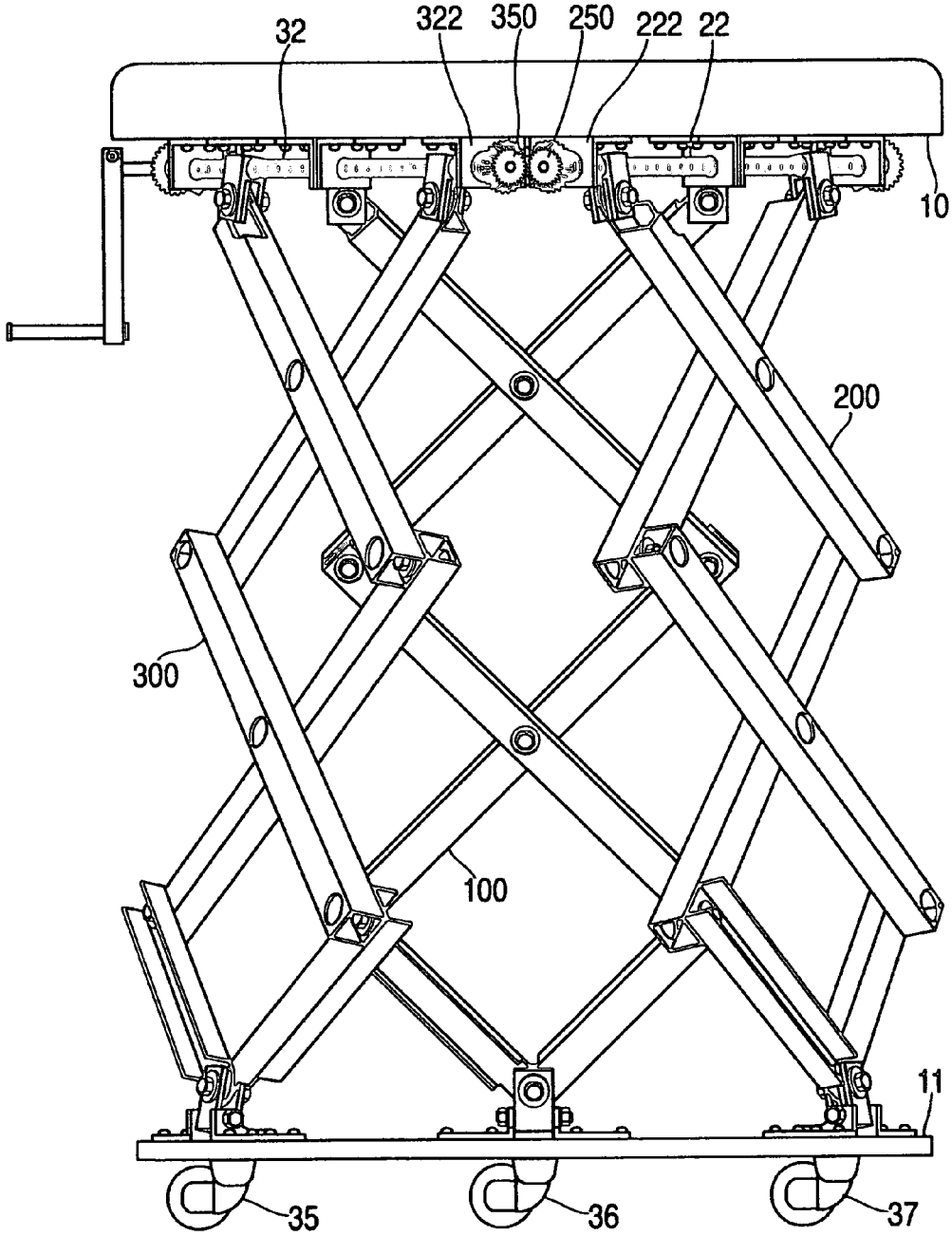
FIG. 2 is a view from the opposite side of FIG. 1, showing an oblique view of the pantographs, their travelers and driving rods, and more clearly showing the gearing connecting them.

For convenience and comfort when used as a seat, FIG. 1 also shows the inclusion of padding or upholstery 15 added to the upper surface 10. Also, for stability when used on uneven surfaces, FIG. 1 show the inclusion of mounting "feet" (25, 26, 27). A variety of such mounting elements may be used, and FIG. 2 shows the use of casters (35,36,37) as one alternative example which will allow rolling or sliding motion.

Figure 6:
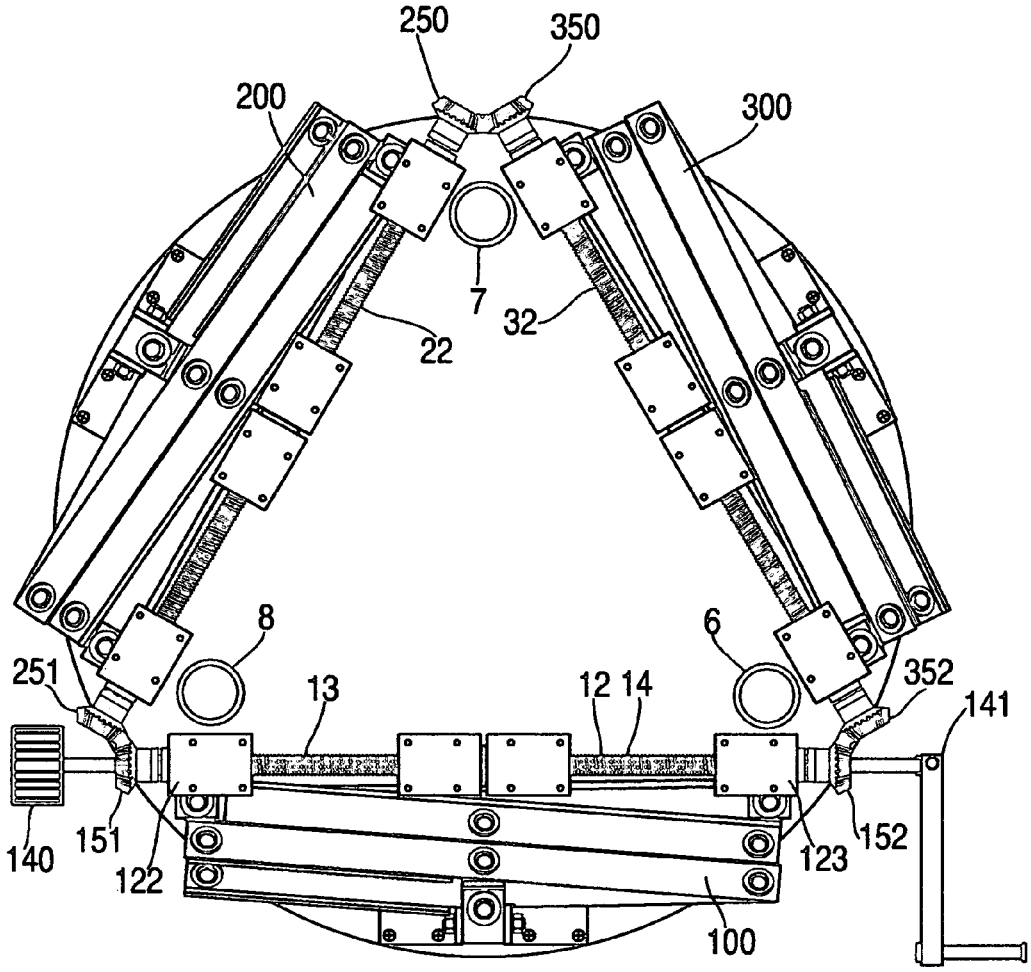
FIG. 6 is a view of the apparatus from above, with upper surface removed, showing the relationship among the driving rods, connecting gears, travelers and pivot mounts, for an embodiment employing three pantograph assemblies

The plan view of FIG. 6 (in which the upper surface 10 has been removed so as to more clearly depict the operating mechanism) shows how a number of pantograph assemblies (in the present illustration three) are connected by means of gearing so that all operate in synchronism. The gearing and rods are configured into a "ring-type" assembly so that all driving rods and other components share all forces equally. Here pantograph assembly 100 (described in detail above) is shown with its driving rod 12 having oppositely threaded portions (13, 14). In this illustration the pantographs are fully retracted, and travelers (101, 102) of pantograph assembly 100 are hidden behind the mounting assemblies (122, 123). In FIG. 6 the other two identical pantograph assemblies (200, 300) are shown with their similarly identical driving rods (22, 32).

FIG. 6 shows how the bevel gear pairs (250, 350), (251, 151), (152, 352) are used to mechanically couple the driving rods (12, 22, 32) together into a "ring-type" configuration. Oppositely "handed" threaded portions of the driving rods (12, 22, 32) are paired up by means of this gearing. Thus a rotation of any of the three rods will cause a corresponding rotation of the other two, and consequently will cause the same motion (either apart or together) of the travelers of all three, thus extending or retracting all pantographs together and in synchronism.

FIG. 6 also shows both a knob 140 and a crank 141 mounted onto extensions of driving rod 12. These are shown for illustrative purposes. In practice, either a knob or a crank, or multiple knobs, cranks or other mechanisms may be mounted onto extensions of any of the shafts as may be convenient for rotating the rods (12, 22, 32) which in turn operate the pantograph mechanisms and so move the surfaces (10, 11) apart from or closer to each other. Additionally, a motor mechanism may be used to drive a gear or gears mounted to any or all the rods (12, 22, 32) from either their ends or, preferably from their center mountings, typically shown as 124 in FIG. 1.

Reference to FIG. 2 will further clarify the gearing mechanism between a pair of the driving rods. In FIG. 2, Driving rod 32 is shown with gear 350 fixedly attached thereto, and bearing assembly 322 supporting this end of the rod. Similarly, driving rod 22 is shown with its attached gear 250, and bearing/mounting assembly 222 supporting the rod end while allowing the rod to rotate freely. As shown, gears 250 and 350 form a 1 to 1 mesh, so that motion of either is transmitted identically to the other, but with opposite rotational sense. In this way, all the gears (151, 251, 250, 350, 152, 352) and rods (12, 22, 32) operate in concert so as to drive all the pantographs (100, 200, 300) simultaneously and identically.

FIG. 3 shows the apparatus from the same vantage point as FIG. 2, but with the pantograph mechanisms (100, 200, 300) more nearly collapsed, and therefore the surfaces (10, 11) closer together. In this view also it can be seen that the pantograph mechanisms (100, 200, 300) are tilted or angled by virtue of their mounting pivots (121, 221, 321) being mounted outward from the center of the mechanism, rather than directly under their respective driving rods, of which only rods 22 and 32 can be seen in FIG. 3. While this method of offsetting is not a requirement of the present invention, it affords the added advantage that when the two surfaces are retracted to minimum extension, it allows the pantographs to "nest" between the pivot points and the driving rods. In this way the minimum distance between surfaces (10, 11) can be made smaller than if this feature is not employed. When used as a table or as a seat, the stability will be greater in this way as well.

Figure 5:
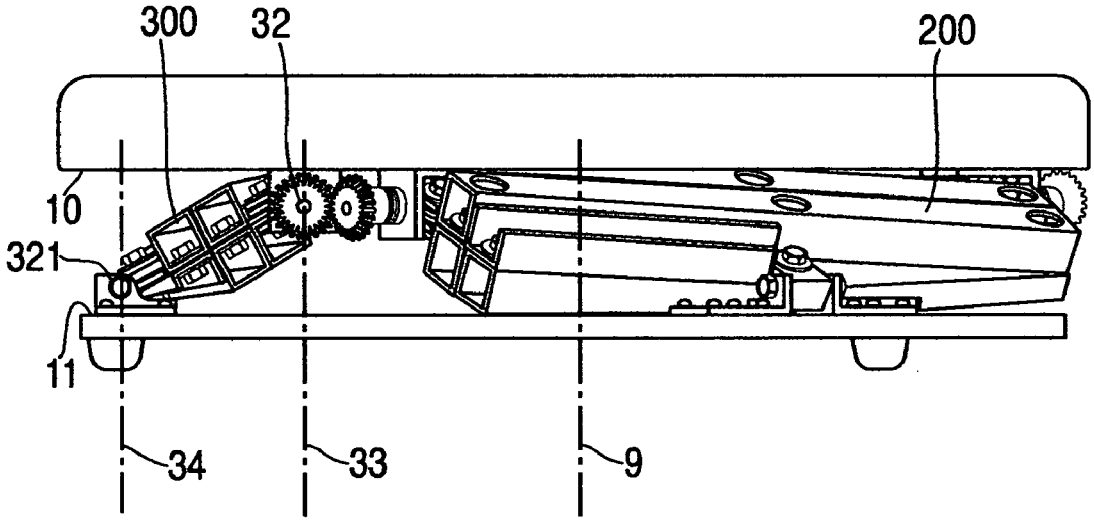
FIG. 5 is a side view of the apparatus oriented directly at the end of a driving rod and its corresponding lower pivot point. Here the apparatus is adjusted for minimal separation of the surfaces. In this view, the pantographs are almost fully compressed, and it can be seen that by offsetting the pivot point from under the driving rod location, the minimal separation between the moving surfaces can be further reduced.

FIG. 5 shows the mechanism as viewed directly toward the end of a driving rod (here shown as 32) and operated to the point near minimum separation between surfaces (10, 11). Here all the pantograph assemblies (200, 300 shown in this view) are almost fully collapsed. The minimum "height" of the pantographs as shown in FIG. 5, is now the distance between the centerline 33 of the driving rod 32 and the centerline 34 of its corresponding support pivot 321, and has been minimized. By positioning the mounting pivot 321 at a greater distance from the mechanism centerline 9 than the centerline (in this case 33), of its corresponding driving rod, the pantograph mechanisms are allowed to fold inward, and thus the minimal separation between surfaces (10, 11) is reduced making for greater compactness of the overall assembly when contracted.

Figure 4:
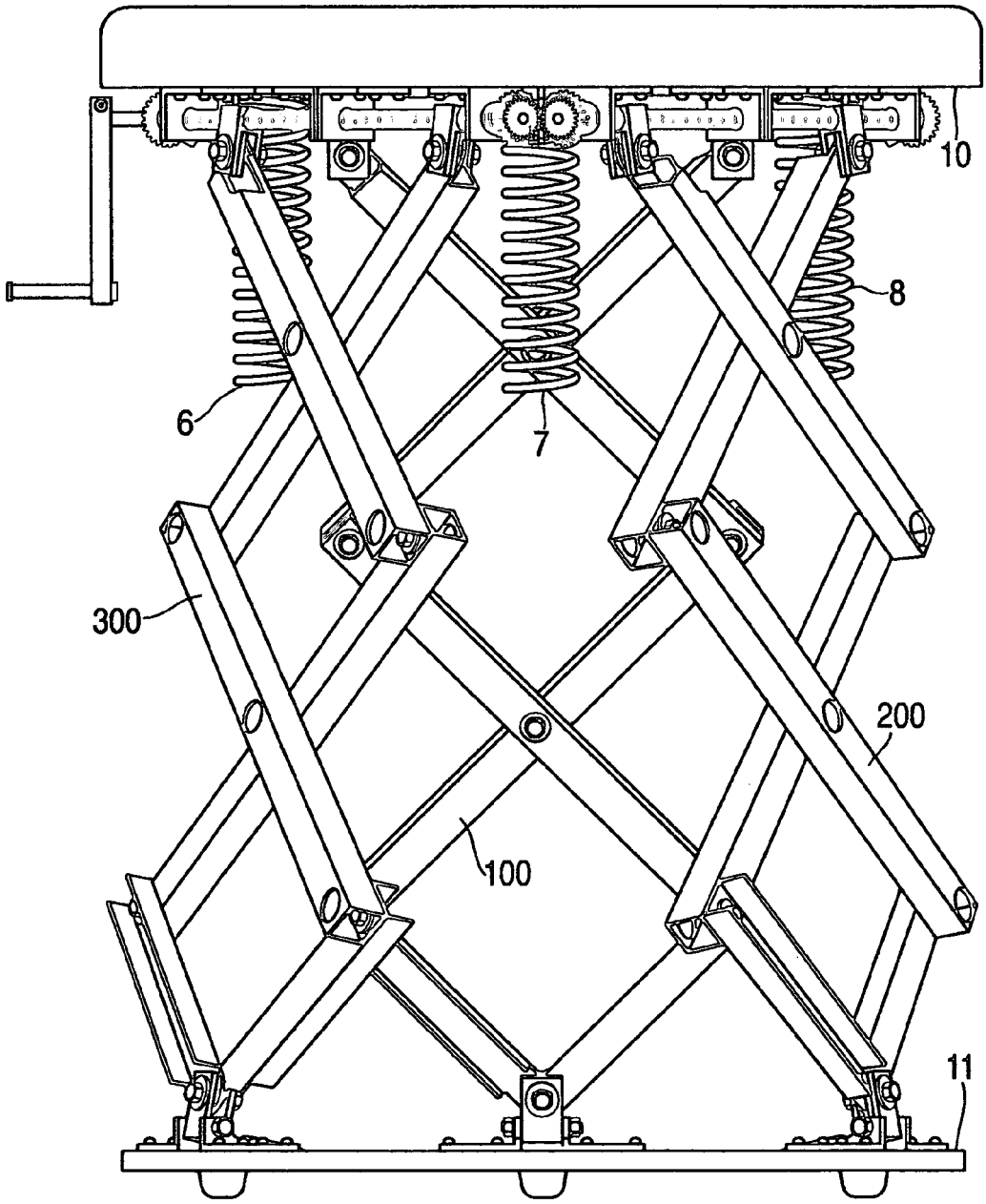
FIG. 4 is a view similar to that of FIG. 1, showing the use of springs which are compressed when the surfaces are minimally separated, and which urge the surfaces apart from that state as the mechanism is operated so as to increase their separation.

Unfortunately, when the technique just described is used to enhance the compactness, a problem arises when expanding the pantographs from this minimal condition. As the driving rods attempt to rotate, and so to drive the surfaces (10, 11) apart, the expansion motion of each pantograph assembly finds a component of its force trying to drive the others into compression. A simple remedy for this problem is shown in FIG. 4, by the addition of springs or spring-like elements (6, 7, 8) positioned so as to urge the surfaces (10, 11) apart when they are minimally separated. These springs may be attached to the upper surface assembly 10, as shown, to the lower surface assembly 11, or elsewhere in the mechanism. Once the surfaces have been separated some small amount, the mechanism requires no further urging, and the springs (6, 7, 8) have done their work. Also, the springs must fit within the space remaining between surfaces (10, 11) when the overall mechanism is compressed fully. Therefore they have been made relatively short as shown.

Figure 7:
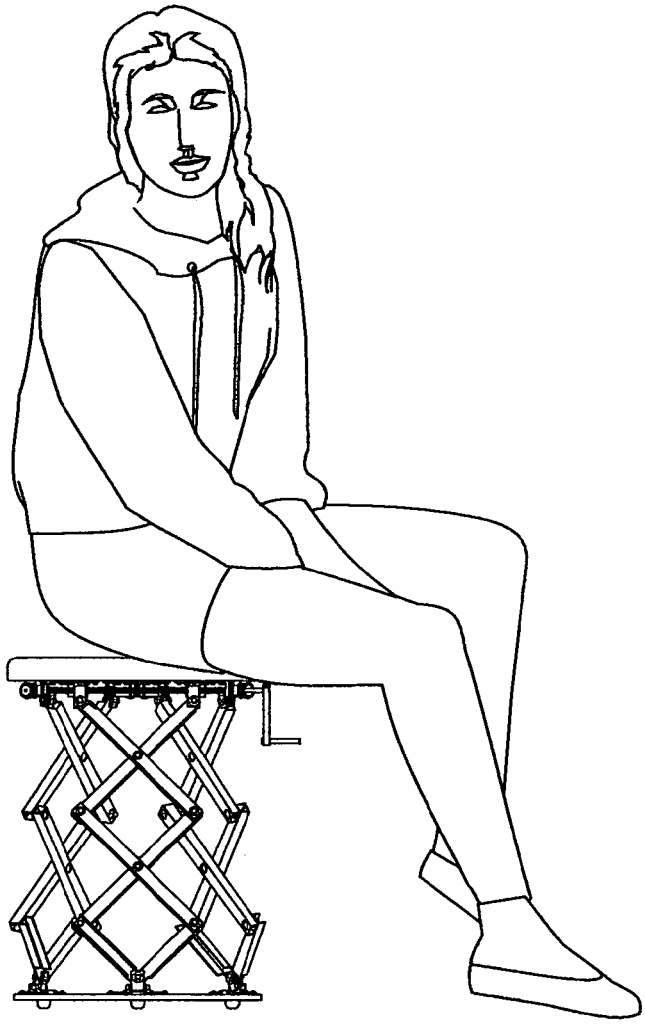
FIG. 7 shows a typical use for the original intended purpose, of a person sitting on the apparatus used as a seat and adjusted to an intermediate height.
Figure 8:
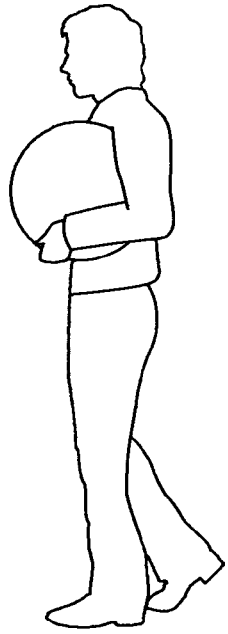
FIG. 8 shows the assembly fully retracted for compact storage, as it might be carried or transported by a person.

The original intent in the development of this invention was to provide a height-adjustable seat which is at the same time small, light, and compact for storage or for transport. This is illustrated in FIG. 7, wherein the mechanism is largely extended, and is used as a seat. In FIG. 8 the entire assembly has been compacted, and is shown being carried as by an individual. It is understood that many other applications for the invention exist as well.

What is claimed is:

1. A seat or table or a pair of parallel moving surfaces connected by three or more pantograph or "lazy tongs" arrangements, whereby the separation between the two surfaces may be adjusted; where said adjustable separation is achieved by means of pairs of "travelers" threadably connected to "driving rods" by means of differentially "handed" threads; said driving rods all mounted to a substantially flat first surface, with one pair of said travelers driving the proximal end of each pantograph, and where all said driving rods are connected by gearing end-to-end in a ring-type configuration, so disposed as to allow all the driving rods to rotate in concert; and where the distal end of each pantograph is hingeably connected to a second substantially flat mounting surface, so that when the said driving rods are rotated the separation between the two said surfaces is altered by means of the expansion or contraction of the driven "lazy tongs" pantographs.

2. The system of claim 1, wherein one of the surfaces my be upholstered or padded as for comfort.

3. The system of claim 1, wherein the threads are multi-lead, or multi-start.

4. The system of claim 1, wherein at least one end of one rod is driven by means of a knob or crank.

5. The system of claim 1, wherein at least one rod is driven by a motor device.

6. The system of claim 1 wherein the distal or "non-driven" pantograph end is mounted other than in line with the driving end.

7. The system of claim 1, wherein the distal, or "non-driven" pantograph end is mounted so as to be able to pivot.

8. The system of claim 1, wherein the pivot points of the "non-driven" pantograph ends are mounted sufficiently far from their common center as to allow the collapsed pantographs to "nest" between the pivot points and the driving rods.

9. The system of claim 1, wherein a spring or set of springs is used to induce the initial movement for separation of the surfaces when the surfaces are driven from their most compacted position to a less compacted position.

10. The system of claim 1, wherein the springs are attached to either of the moving surfaces.

11. The system of claim 1 wherein a plurality of support components are used to allow for steady placement on an irregular surface.

12. The system of claim 11 where the support components allow rolling motion.

13. The system of claim 1 where the pantograph elements are made of material having a substantially square cross-section.

* * * * *